US006037919A

United States Patent [19]

Hanson

[11] Patent Number: 6,037,919

[45] Date of Patent: Mar. 14, 2000

[54] LCD WITH VARIABLE REFRESH RATE AS A FUNCTION OF INFORMATION PER LINE

[75] Inventor: George E. Hanson, Andover, Kans.

[73] Assignee: Intermec IP Corp., Woodland Hills, Calif.

[21] Appl. No.: 08/914,825

[22] Filed: Aug. 19, 1997

Related U.S. Application Data

[63] Continuation-in-part of application No. 08/374,499, Jan. 18, 1995, abandoned, and a continuation-in-part of application No. 08/324,647, Oct. 18, 1994, abandoned.

[51] Int. Cl.[7] ..... G09G 3/36

[52] U.S. Cl. ..... 345/87; 345/100

[58] Field of Search ..... 345/87, 97, 98, 345/99, 100, 103

[56] References Cited

FOREIGN PATENT DOCUMENTS

| | | | |
|---|---|---|---|
| 617399 | 3/1994 | European Pat. Off. | 345/87 |
| 2271458 | 4/1994 | United Kingdom | 345/87 |

*Primary Examiner*—Matthew Luu
*Attorney, Agent, or Firm*—Suiter & Associates, PC

[57] ABSTRACT

An electronic video display system having a video controller device, a video memory device, a video pattern file, video display driver devices, a video display panel, and a means for controlling the video refresh rate in order to improve the displayed video image are described. Redundant information in a line of the display is written simultaneously rather than sequentially. The overall contrast of the display is thereby enhanced.

8 Claims, 4 Drawing Sheets

LCD WITH VARIABLE REFRESH RATE AS A FUNCTION OF INFORMATION PER LINE

CROSS-REFERENCE TO RELATED APPLICATIONS

The present application is a continuation-in-part of U.S. application Ser. No. 08/374,499 filed Jan. 18, 1995, now abandoned, which in turn is a continuation-in-part of U.S. application Ser. No. 08/324,647 filed Oct. 18, 1994, now abandoned.

BACKGROUND OF THE INVENTION

The invention relates generally to the field of liquid-crystal display devices used in electronic equipment and more specifically to refreshing video images on such displays.

Liquid-crystal displays (LCDs) are commonly used in a variety of electronic devices. The nematic crystals which comprise liquid-crystal displays have extremely low current requirements making liquid-crystal displays ideal for battery powered portable device applications.

Liquid-crystal display devices generally contain a nematic fluid having fairly large linear molecules which exhibit bipolar characteristics. The bipolar molecules of a liquid-crystal will align themselves in response to an externally applied electric field. In the absence of an externally applied electric field the bipolar molecules of the nematic fluid align themselves according to the inherent electric field generated from other surrounding bipolar molecules thereby representing the lowest collective energy state for that particular group of similar molecules.

The orientation of the molecules of the nematic fluid may be modulated by an externally applied electric field. The initial orientation of the nematic fluid molecules is controlled by directionally etching the interior surfaces of the glass plates containing the nematic fluid in the liquid-crystal display. This etch controls the direction of the initial low energy orientation of the nematic fluid molecules.

The orientation of the bipolar molecules subtractively affects the polarization of light passing through the liquid-crystal display. Modulation of the bipolar molecules allows for control of the light passing through the display. The degree of polarization of the light passing through the display may be controlled within limits by controlling the intensity of the externally applied electric field. A pixel is defined by the placement of transparent electrodes between the glass plates which contain the nematic fluid. Thus the bipolar molecules in the liquid-crystal display may be modulated in varying patterns and sequences to create the desired display image.

In order to control the voltage signals to the large number of pixels in the liquid-crystal display array it is necessary to multiplex the signal applied to the display electrodes. Specifically, the video signal is time-division multiplexed so that any given pixel is accessed for only that portion of time that it receives an applied voltage. So long as the multiplex rate is great enough, the human eye cannot detect that the bipolar molecules are polarized for a only a fraction of the time. Upon removal of the externally applied field an excited nematic fluid molecule will gradually revert to the low energy orientation defined by the directional etch. Greater such relaxation times such as exhibited by supertwisted nematic displays result in higher contrast ratios thereby allowing for higher multiplex rates.

As portable computer terminals and electronic equipment become more powerful, there is a trend for the video displays to become larger. When a larger liquid-crystal display is desired, more pixels are required in the array, and the display signal is multiplexed among a greater number of electrodes. Therefore each individual pixel is accessed for a smaller portion of the time. When a pixel is accessed for a smaller length of time, the contrast of the video image, the difference in intensity between the dark and light portions of the picture, and picture quality are reduced.

One solution to this problem is to drive the nematic fluid molecules with a higher voltage at higher multiplex rates in order to improve the video contrast ratio. Ideally the product of the voltage application time and the applied voltage remains constant as the multiplex rate increases. However, the resulting increased contrast is limited by the physical characteristics of the nematic fluid. If voltage applied to the nematic fluid is too large the nematic fluid will undergo dielectric breakdown causing the electrode material to plate across the fluid thereby damaging the display. Additionally, the response time for the molecules to reorient themselves has a maximum limit such that the molecules are unable to respond as rapidly as they are driven.

Increased power consumption of the voltage conversion electronics is a problem of using higher driving voltages because the efficiency of the voltage converters decreases as the magnitude of required voltages increases. The limit of the physical characteristics of the nematic fluid also presents problems when voltages are increased to compensate for increased multiplex rates. These problems are amplified as the density of pixels utilized in liquid-crystal displays is increased because the greater number of pixels inherently requires greater multiplex rates.

In most video applications, only a small portion of the display changes from one video refresh cycle to the next. Additionally, much of the information contained on several lines is identical or a subset of information contained on another line. Consideration of this redundancy of video information would allow the multiplex rate for each control cycle to be maximized for a given number of pixels in the liquid-crystal display, thereby maximizing the contrast ratio and picture quality for the desired video image.

SUMMARY OF THE INVENTION

Accordingly, it is a goal of this invention to improve the contrast and performance of a liquid-crystal display.

It is an object of the invention to vary the refresh rate of a liquid-crystal display as a function of the redundancy to the video information to be displayed.

It is another object of the invention to optimize the video multiplex rate as a function of the video information to be displayed.

A further object of the invention is to provide a display image having an optimized readability for a given multiplex rate.

An electronic video display system comprises of a video controller, video random-access memory, a video pattern file, video display drivers for the rows and the columns, a liquid-crystal display (LCD) panel, and a method for controlling the video refresh rate. The video pattern file contains digitally encoded video patterns corresponding to the video patterns contained in each row of the display. The video display driver devices include row and column drivers that send the multiplexed video signals to the LCD.

In accordance with one aspect of the invention the video refresh rate varies from one cycle to the next. In order to increase the effective multiplex rate, lines of video that contain the same video patterns are written simultaneously, and lines of video that contain unique patterns are written sequentially. In accordance with another aspect of the invention, lines of video that contain video patterns that are a subset of the video patterns contained in other lines of the video image are written back into those other lines concurrently with the subset lines.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to the presently preferred embodiment of the invention, an example of which is illustrated in the accompanying drawings.

Figure 1:
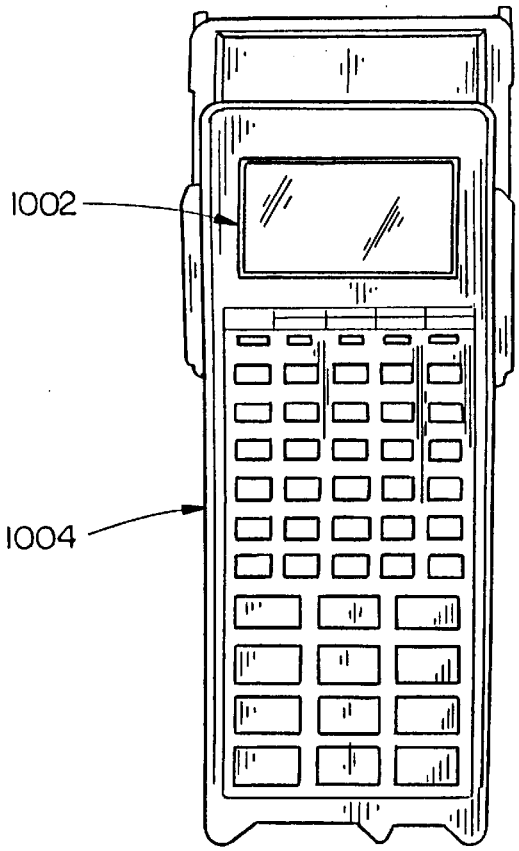
FIG. 1 is an illustration of a portable computer system employing a large sized liquid-crystal display in which the disclosed invention is utilized.

Referring now to FIG. 1, a portable computer data terminal 1004 in which the present invention may be utilized with a large sized liquid-crystal video display 1002 is shown. Other applications of liquid-crystal displays may further utilize the teachings of the present invention as well. A major design criterion for a portable computer such as terminal 1004 is to optimize the contrast and readability of the video image and the information displayed on the LCD 1002. The present invention optimizes readability of the liquid-crystal video display 1002 by varying the effective multiplex rate so that the effective multiplex rate is maximized for each video refresh cycle. The multiplex rate is varied as a function of the redundancy of the video information to be displayed.

Figure 2:
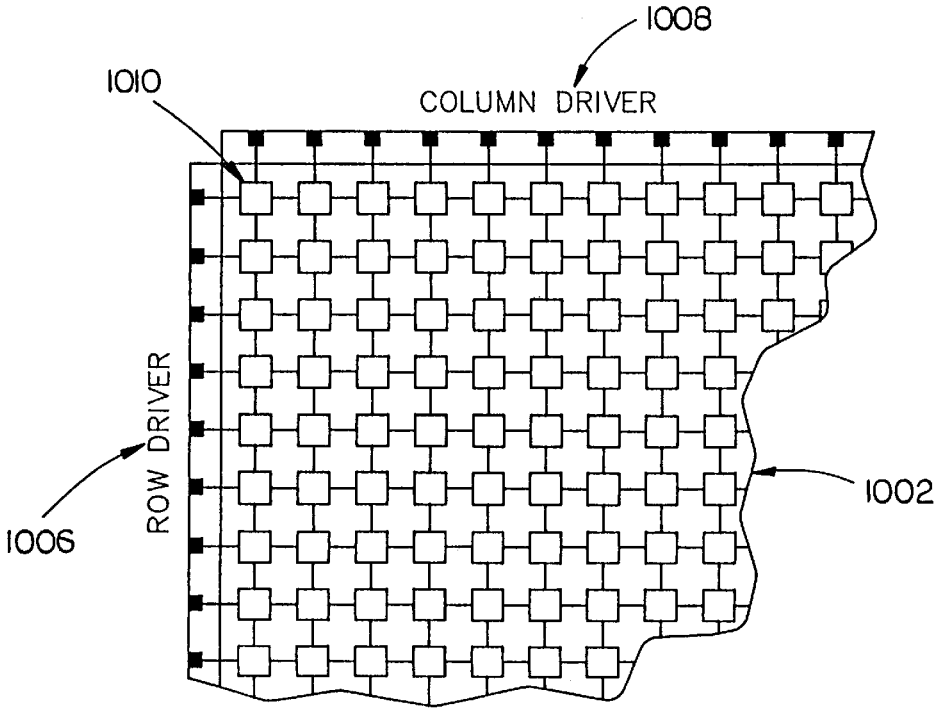
FIG. 2 is a representation of the pixel arrangement in a liquid-crystal display.

FIG. 2 is a schematic illustration of the arrangement of the pixel array on a section of a typical liquid-crystal video display 1002 with which the present invention is utilized. Each pixel is accessed by sending a signal to the corresponding row and column through the row driver 1006 and the column driver 1008. FIG. 2 is not drawn to scale and is used for purposes of illustration only, as the true spacing between pixels on the liquid-crystal display 1002 is typically only one or two percent of the pixel width. As with typical LCD driving schemes, a first row is selected by the row driver 1006 and the column information corresponding to that row is sequentially written by the column driver 1008. The sequence is essentially a serial process that is driven by a clock signal. Further, equal time is allocated for driving rows that have information and for rows which contain no information to be displayed to result in a multiplex rate inversely proportional to the total number of columns. After the last column in the first row is driven, the row driver selects the next row, and the columns are again sequentially driven by the column driver. This pattern continues until all columns for the last row have been driven, and then repeats at the first row. Alternatively, the roles of the row and column may be switched such that a first column is selected and then all of the row information for that column is written and so on. The terms "column" and "row" may be used interchangeably herein. Thus the term "line" may be used to refer to either a single column or a single row.

Figure 3:
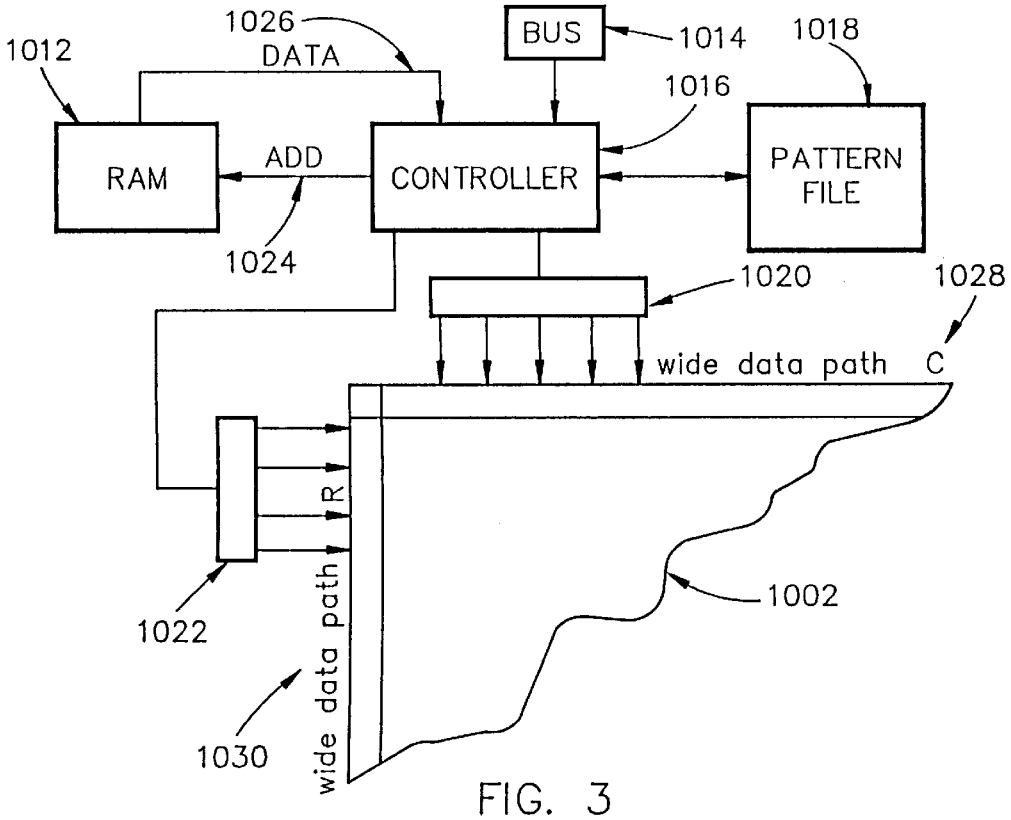
FIG. 3 is an diagram of the video control system used in the invention.

FIG. 3 depicts the video control system that monitors the patterns of video information to be displayed on the liquid-crystal display. The video information is sent to the video controller 1016 ("CONTROLLER") via the system bus 1014 ("BUS"). The video controller 1016 scans the video data currently being added to the video random-access memory 1012 ("RAM") through the add line 1024 ("ADD") of the video controller 1016, and a video pattern file 1018 ("PATTERN FILE") is generated from this data and then stored. The video data is then sent through the data line 1026 ("DATA") back to the video controller 1016 where it is processed and subsequently sent to the column driver 1020 and the row driver 1022. The row and column signals are then demultiplexed by the respective drivers and sent to the liquid-crystal display 1002 through the column data path 1028 ("WIDE DATA PATH C") and the row data path 1030 ("WIDE DATA PATH R")

Figure 4:
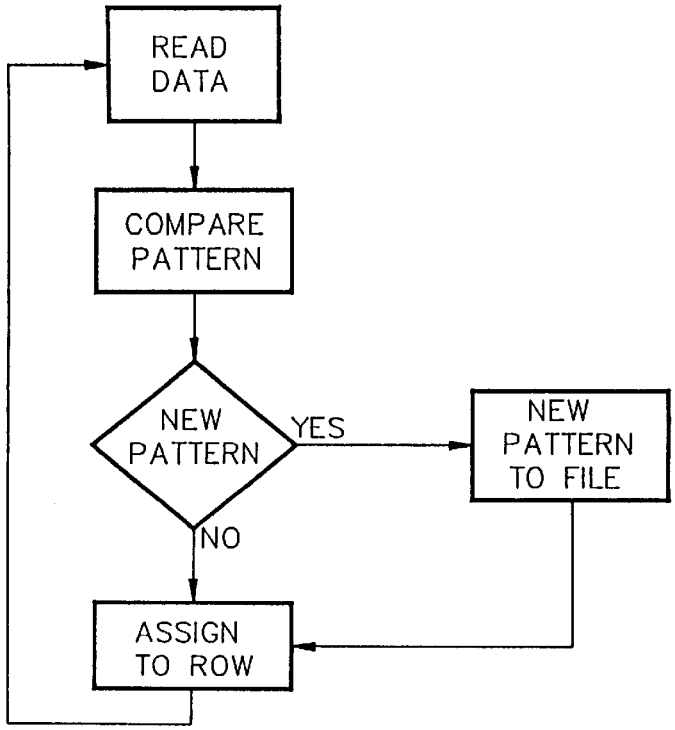
FIG. 4 is a control logic flow diagram of the algorithm used to monitor the video information pattern.

FIG. 4 shows a sequence diagram of the how the video controller 1016 compares the incoming video data to the data in the PATTERN FILE 1018 in order to maximize the multiplex rate. In accordance with the present invention, the incoming video data is read by the controller 1016 and then compared to the video date stored in the pattern file 1018. The information pattern of the rows is scanned to determine whether or not there are any pattern matches. A particular pattern is digitally encoded wherein each pattern is assigned to a particular digital code number corresponding to the particular video pattern. If the incoming data is a new pattern, then the new pattern is added to the pattern file 1018 and then assigned to the corresponding display row. Otherwise if the pattern number is duplicated in another row of the display, the old pattern is assigned to the corresponding display row. Once new video data is input to the video system, the pattern comparison routine begins a new cycle.

In an exemplary embodiment of the invention, blank lines of video information are not accessed. By skipping blank lines the denominator of the multiplex rate factor is decreased by one for each blank line skipped where the multiplex rate factor is the inverse of the number of rows or columns to be accessed.

Figure 5:
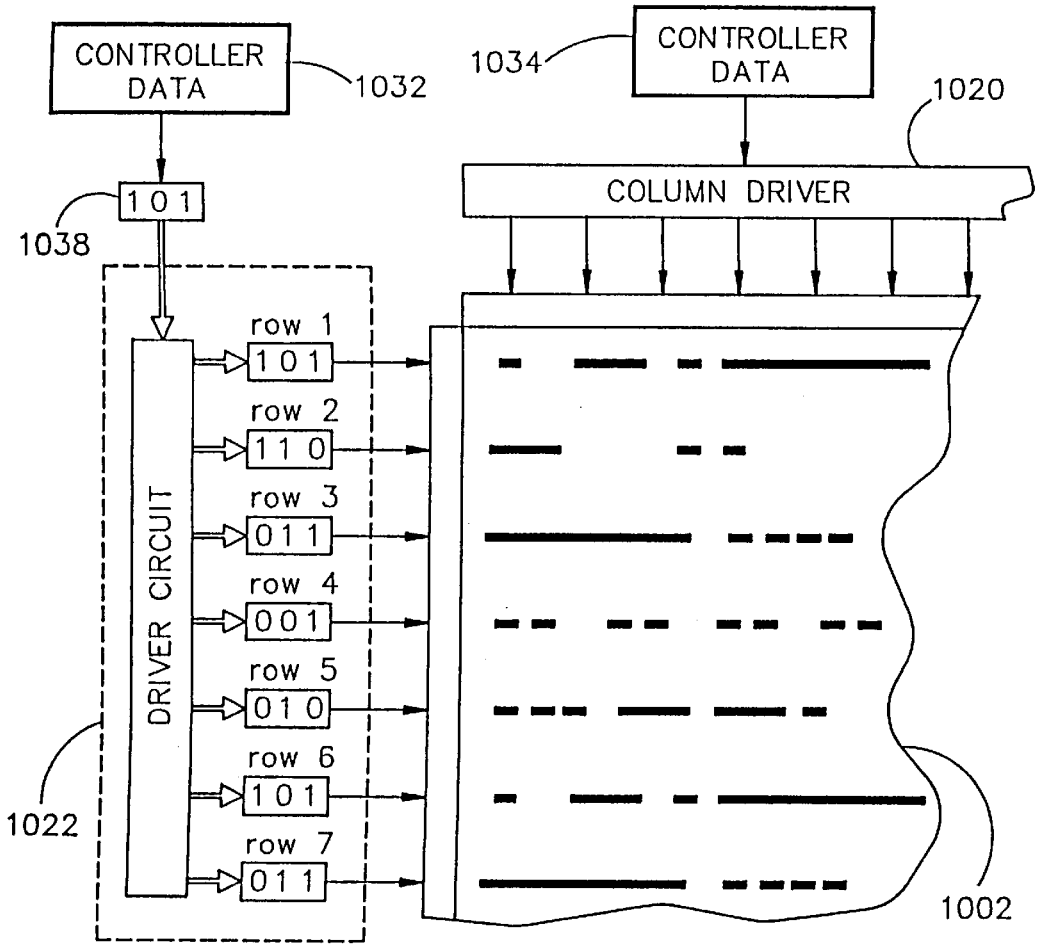
FIG. 5 is an illustration of redundant video display information used to increase the multiplex rate factor.

FIG. 5 illustrates how the redundancy of display information is used to increase the rate at which display pixels are accessed by increasing the multiplex rate. This diagram depicts a section of the liquid-crystal display 1002 wherein seven rows are shown. It can be seen in FIG. 5 that row 1 and row 6 have the same display pattern. Row 3 and row 7 also contain identical patterns. In a normal display circuit the multiplex rate factor for the rows shown in FIG. 5 would be 1/7 (each row being accessed one-seventh of the time during a refresh cycle) because the rows are serially addressed. Typical multiplex rates factors are usually inverse powers of 2, e.g. 1/64, 1/128, etc. In the operation of the disclosed invention, row 1 and row 6 both have pattern 101 therefore both row 1 and row 6 may be driven simultaneously. Further, row 3 and row 7 both have pattern 011 and they in turn may be driven simultaneously. In a typical LCD driving scheme, only row 1 is selected and the column information in row 1 is sequentially written. In a typical case the column information for row 6 is not written until after the column information for rows 2 through 5 are written. However, with the present invention, rows 1 and 6 are simultaneously selected and the column information for rows 1 and 6, being redundant, are simultaneously written. Thus, the effective multiplex rate factor at which the row driver 1022 operates is effectively increased from 1/7 to 1/5 in this example.

The increase in the multiplex rate factor in this example translates into a 40% increase in the frequency at which the rows are accessed. Increased access to the rows translates into a substantial improvement in the video contrast ratio. The better video contrast ratio results in better viewability of the information displayed on the liquid crystal display 1022. The actual rate at which the columns are accessed is related to the product of the effective multiplex rate factor and the operational bandwidth at which the video circuitry is driven.

In the embodiment illustrated in FIG. 5, the column driver 1036 receives controller data 1034 and drives the columns and displays the column video information for each accessed row. Additionally, since video information and resulting row patterns will vary from refresh cycle to refresh cycle, the effective multiplex rate factor will vary from one refresh cycle to the next. Because the effective multiplex rate factor varies from one refresh cycle to the next, the refresh rate is elastic and varies according to the information redundancy per line. The smallest multiplex rate factor will occur when there are no identical row patterns, in which case the multiplex rate factor for the invention is the same as with a conventional liquid-crystal display system. The theoretical maximum multiplex rate factor is one (i.e. all rows accessed simultaneously) when all rows contain an identical pattern of video information.

Figure 6:
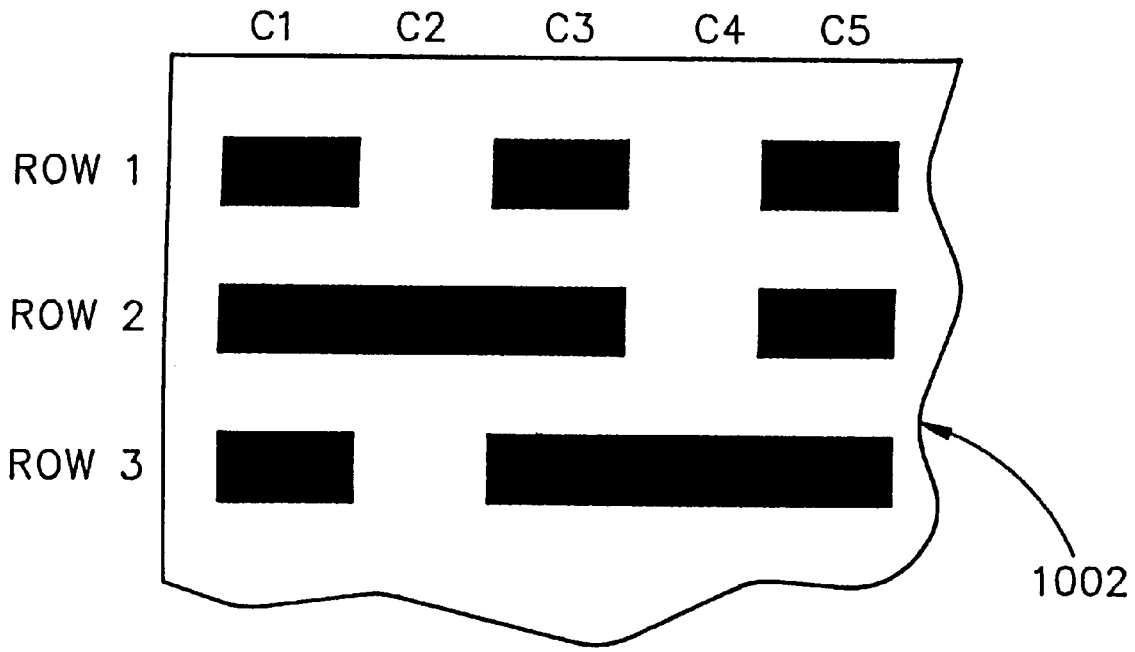
FIG. 6 is an illustration of redundant video information wherein subset row information is used to reduce the effective multiplex rate factor.

FIG. 6 depicts the operation of a display in an exemplary embodiment of the invention. The method as described with respect to FIG. 5 is not intended to apply only where lines that are identical in their entirety are written simultaneously. As can be seen from FIG. 6, at row 1, columns C1, C3 and C5 have contain identical information, and columns C2 and C4 are blank. Thus, row 1 may be selected and columns C1, C3 and C5 are simultaneously written. Columns C2 and C4 are skipped. Because row 1 is a subset of row 2, row 2 may also be selected and at the same time that row 1 is selected. Further, because row 1 is also a subset of row 3, row 3 may be selected at the same time that row 1 is selected. This the column data for row 1 is written simultaneously for rows 2 and three. The superset information for rows 2 and 3 are then written. If the superset information for rows 2 and 3 are identical, then the information is written simultaneously and otherwise written sequentially. Blank data is not latched. Thus, with a typical LCD driving scheme, fifteen clock cycles would be required for a single refresh cycle of the video information shown in FIG. 6. However, with the LCD driving method of the present invention herein described, only three clock cycles are required for a single refresh cycle. In the first cycle, columns C1, C3, and C5 of rows 1, 2 and 3 are written simultaneously on the first clock cycle. Column C2 of row 2 is then written on the second clock cycle and column C4 of row 3 is written on the third clock cycle. The blank information is skipped.

In the subset embodiment, if a row that contain patterns which are a subset of another row then both of the rows may be turned on simultaneously. Additionally, rows which are identity sets of, or identical to, other rows may also be turned on simultaneously. The term "subset" is sometimes defined so as to include the "identity set" such that if two sets contain exactly the same elements, then one set may be referred to as a "subset" of the other. However, as defined in this patent, the term "subset" is used herein to specifically exclude the "identity set" as described above. Therefore, if two sets contain identical information, then either set by definition is not a "subset" of the other in accordance with the definition of the term subset as used herein. When it is intended herein to refer to a first set being identical with a second set, then the term "identity set" will be used. Thus, a first set is a subset of a second set only when the second set contains all of the elements of the first set plus at least one additional element which is not contained within the first subset. In the case where a first set contains all of the elements of a second set and the two sets have an equal number of elements, then the first set is an identity set of the second set and is not a subset of the second set.

Thus, as shown in FIG. 6, whenever column data for row 1 is set, the row driver for row 2 and row 3 may be turned on simultaneously. This will increase the effective multiplex rate factor and thereby improve the video contrast ratio. This subset row access feature will generate rows that have a variable video contrast ratio along the length of the rows. In an exemplary embodiment the controller may implement the subset row feature.

Figure 7:
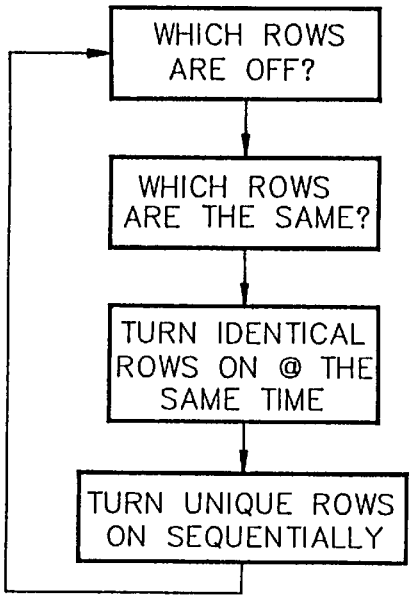
FIG. 7 is a control logic flow diagram of the algorithm to reduce the multiplex rate by consideration of redundant video display information.

FIG. 7 shows a sequence diagram for an algorithm that increases the effective multiplex rate factor. The video controller 1016 determines which rows are off. If a row is off, i.e. blank, then it is not multiplexed. Next the video controller 1016 determines which rows are the same as another row, or alternatively which rows are a subset of another row. Rows that are identical are turned on simultaneously and the column data for those rows are sequentially written. Rows that are unique are successively accessed for sequential writing of their respective column data. The video controller 1016 then executes another refresh cycle.

Thus with the present invention, multiple columns or rows may are simultaneously driven in the display device. The present invention provides an LCD having a variable refresh rate signal. Thus, the driving of the display may be considered elastic and flexible in accordance with the redundancy of the information per line. Multiple data lines (rows or columns) are moved to the display. Access to the LCD is thereby increased, and the time for a full LCD scan is shortened.

In all LCDs, contrast ratios are an issue. The actual multiplex rate generally sets the maximum contrast ratio. When multiple columns are driven simultaneously, instead of sequentially, the multiplex rate is increased. Further, by not spending time driving zeros in the sequence, the multiplex rate is increased even more.

There are three situations of which the present invention takes advantage. The first situation is where data in a column is blank. Blank column or row data is skipped. The second situation is where two or more of the columns are identical. All of the identical columns are simultaneously driven in one latch time. The third situation is where two lines are such that the row configuration for the first line is contained within the second line, that is the first line is a subset of the second line. All columns exhibiting the subset are driven simultaneously. Then the superset elements and identical sets are to driven at the same time. Finally, all non-redundant lines are sequentially driven.

The method according to the present invention generates and "elastic" refresh rate clock. The refresh rate depends upon the data content of the display. A blank display set is never refreshed. A single column on the display is driven every cycle if that is all that is on the display.

It is believed that the LCD with variable a refresh rate as a function of information redundancy per line of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A method for driving a liquid-crystal display, comprising:

(a) reading a video information pattern file to be displayed on the liquid-crystal display, said video information pattern file containing row and column data;

(b) selecting a row;

(c) comparing said column data for said selected row;

(d) determining which columns contain redundant display information at said selected row; and (e) driving simultaneously the columns that contain redundant display information at said selected row.

2. A method according to claim 1, further comprising the steps of selecting successive rows and repeating said steps (c), (d), and (e) for each of said successive rows.

3. A method according to claim 1, further comprising the steps of determining which columns contain no display information, and skipping said columns containing no display information.

4. A method for driving a liquid-crystal display, comprising:

(a) reading a video information pattern file, said video information pattern file containing row and column data;

(b) at a selected row, sequentially writing at a multiplex rate the video information at successive columns corresponding to the selected row; and (c) comparing said column data for said selected row;

(d) determining which columns contain redundant display data for said selected row; and (e) increasing the multiplex rate by driving simultaneously said columns contain redundant display data for said selected row.

5. A method according to claim 4, further comprising the steps of selecting a successive row an repeating said steps (c), (d), and (e).

6. A method according to claim 4, further comprising the steps of determining which columns contain no display information, and skipping said columns containing no display information.

7. A method according to claim 4, further comprising the steps of (f) selecting additional rows;

(g) comparing said column data for said additionally selected rows;

(h) determining if said selected row in step (b) containing redundant display data has column data which is a nonidentical subset of column data for said additional selected rows; and (i) driving simultaneously said columns of the selected row in step (b) and said additional rows.

8. A method according to claim 7, further comprising the step of simultaneously writing non-written column display data of said additional selected rows which is redundant with the column display data of other rows.

* * * * *